United States Patent [19]

Wass

[11] Patent Number: 4,595,374

[45] Date of Patent: Jun. 17, 1986

[54] RAFT INFLATION VALVE

[76] Inventor: Lloyd G. Wass, 1670 Blackhawk Cove, Eagan, Minn. 55123

[21] Appl. No.: 484,454

[22] Filed: Apr. 13, 1983

[51] Int. Cl.[3] ..... B64D 17/00

[52] U.S. Cl. ..... 441/35; 441/41; 251/294; 251/324; 251/900

[58] Field of Search ..... 441/40, 41, 96, 99, 441/92–95, 100, 101; 251/215, 294, 319, 325, 324, DIG. 1, 216; 137/68 R

[56] References Cited

U.S. PATENT DOCUMENTS

| | | | |
|---|---|---|---|
| 3,150,388 | 9/1964 | Oliphant | 441/41 |
| 3,491,783 | 1/1970 | Linsalato | 251/216 |
| 3,570,805 | 3/1971 | Moran et al. | 251/38 |
| 3,768,761 | 10/1973 | Cramer | 441/41 |
| 3,782,413 | 1/1974 | Chacko | 441/41 |
| 3,853,146 | 12/1974 | Blair | 251/324 |
| 4,269,386 | 5/1981 | Crowe | 441/96 |
| 4,288,005 | 9/1981 | Soo-Hoo | 137/68 R |

FOREIGN PATENT DOCUMENTS

| | | | |
|---|---|---|---|
| 1173966 | of 1960 | France | 251/324 |

*Primary Examiner*—Trygve M. Blix
*Assistant Examiner*—Edwin L. Swinehart
*Attorney, Agent, or Firm*—Kinney & Lange

[57] ABSTRACT

A raft inflation valve, which is actuated by pulling a detachable cable connected to one end of a piston, thereby allowing inflation gas to flow from an attached pressure vessel into an inflatable raft includes a valve body having an inlet, an outlet, an internal cylinder open at one end to the valve outlet, and an inlet passage leading from the valve inlet to and intersecting with the midsection of the internal cylinder. A double-ended piston with O-ring seals on both ends is positioned in the internal cylinder so that one end blocks the passage to the outlet. In this position (valve closed) the O-ring seals are on opposite sides of the intersection of the inlet passage which results in a balancing of the gas pressure forces acting on the piston, thereby allowing the piston to be moved (for actuation) by simply overcoming the O-ring drag on the internal cylinder wall. This results in a low actuation force that is only remotely related to the operating pressure of the inflation system. The valve is actuated by moving the piston away from the outlet end of the internal cylinder so that the piston head partially uncovers the outlet passage. Once the outlet passage is partially uncovered, the gas pressure forces on the piston become unbalanced and the pressure rapidly accelerates the movement of the piston the remaining distance out of the passage, which then allows the inflation gas to flow freely through the valve to the raft.

23 Claims, 6 Drawing Figures

Fig.3
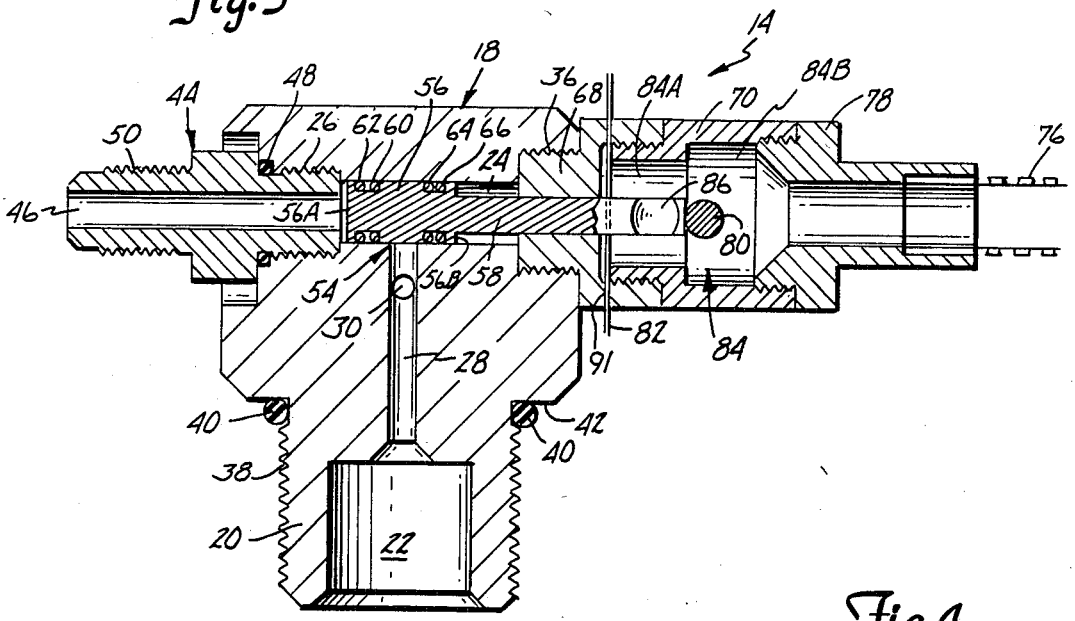
Fig.4
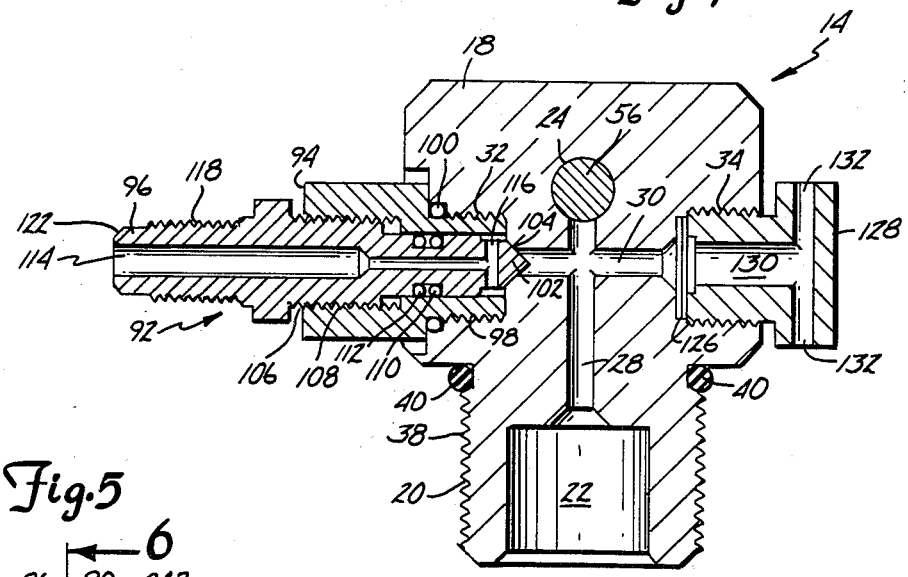
Fig.5
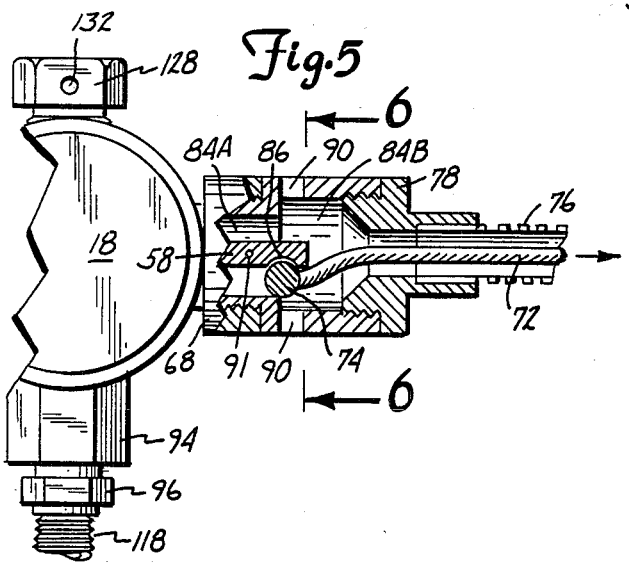
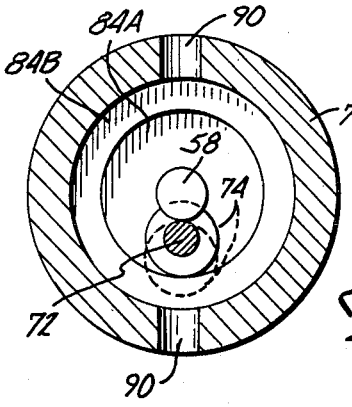
Fig.6

RAFT INFLATION VALVE

BACKGROUND OF THE INVENTION

1. Field of the Invention

The present invention relates to life raft inflation equipment. In particular, the present invention relates to an improved raft inflation valve which controls the flow of pressurized gas from a pressure vessel to an inflatable life raft.

2. Description of the Prior Art

Inflatable life rafts have found wide use on ocean-going ships and aircraft. An inflatable life raft offers the advantage of light weight and small size. It is stored in its deflated condition for long periods of time when it is not needed, and yet can be inflated rapidly when it is needed to form a large raft capable of holding relatively large numbers of people.

Inflatable life rafts are inflated using a pressurized inflation gas (such as carbon dioxide, dry air, or nitrogen) which is contained in a pressure tank. When the raft is to be inflated, a valve is actuated by pulling a pull cable which is connected at one end to the valve actuating mechanism in such a manner so as to allow the cable to pull free after the firing mechanism has been actuated. The pull cable is typically connected at its other end to the ship. The pull cable is automatically pulled, therefore, when the raft is thrown overboard or when the ship sinks. The valve opens when actuated to permit the pressurized fluid to expand and fill the life raft.

Originally, and prior to the advent of high pressure technology, all inflation systems used carbon dioxide stored in liquid form in the pressure tank. Carbon dioxide undergoes a phase change from liquid to gas when the valve is actuated and the raft is inflated. Becase of severe thermodynamic effects on temperature caused by the phase change and rapid pressure drop, carbon dioxide has a tendency to freeze (form dry ice) or slush-up in cold weather. This frequently causes a "plugged" valve which results in a slow or partial inflation that can render the raft of little or no emergency use value.

To overcome the shortcomings of the carbon dioxide raft inflation systems, systems using pressurized dry air as the inflation gas were developed and perfected by the U.S. Navy during the middle 70's. The dry air systems do not suffer from the freeze-up problems associated with carbon dioxide systems. They do require, however, that the dry air be stored at a much higher pressure (normally in the range of about 5,000 psi) because dry air does not undergo a phase change expansion like carbon dioxide. The advent of the high pressure dry air systems for life raft inflation required the development of raft inflation valves which were capable of operating reliably at these high pressures, while at the same time offering low activating force. One highly advantageous raft inflation valve has been the Marada Mark VI valve manufactured and sold by Marada Research and Manufacturing of Chaska, Minn. This valve, two of which are used on the U.S. Navy's 25-man Mark VI raft, is a stainless steel valve with a movable spool. The spool is biased by a spring to maintain the valve in a normally closed position. When the pull cable is pulled, it causes a cam to be rotated, which moves the spool against the spring force to open the valve.

The Marada Mark VI valve has provided very reliable operation at the high pressures, and is capable of being actuated with a relatively low pull force on the pull cable (typically less than 20 pounds). The Marada Mark VI valve, however, because of the intricate design and the relatively large number of high precision parts required, has been expensive to manufacture. In addition, like other raft inflation valves, it has been susceptible to contamination if the source of the inflation gas (in this case dry air) contains dust, dirt particles, or other contaminants.

Thus there has been a continuing need for an improved raft inflation valve which provides ultra-high reliability, is capable of handling high pressures (up to for example, 6,000 psi), has a low actuating force, is not affected by contamination or environmental changes, and is easy and relatively inexpensive to manufacture.

SUMMARY OF THE INVENTION

The present invention is a raft inflation valve which is normally closed, and which is actuated to permit the flow of pressurized gas from a pressure vessel to an inflatable life raft. The raft inflation valve of the present invention includes a valve body, a double-ended piston, and valve actuating means for causing the valve to open in order to inflate the raft.

The valve body of the valve of the present invention includes an inlet which is connected to the pressure vessel, an outlet which is connected to the inflatable raft, an internal cylinder, and an inlet passage. The internal cylinder is open at a first end to the outlet. The inlet passage extends from the inlet and intersects the internal cylinder.

The double-ended piston has a piston head which is movable in the internal cylinder, a piston rod which is connected to the piston head which extends out a second end of the cylinder, and a pair of spaced apart O-ring seals. In the normally closed condition of the valve, the piston head is positioned so that the O-ring seals are positioned on opposite sides of the inlet passage when the valve is in its normally closed condition. The O-ring seals, therefore, block gas flow between the inlet and the outlet.

This results in a balancing of the gas pressure forces acting on the piston, while allowing the piston to be moved (for actuation of the valve) simply by overcoming the O-ring drag on the internal cylinder wall.

The valve actuating means pulls the piston rod to cause the piston head to move away from the first end and toward the second end of the cylinder. Once the intersection of the internal cylinder and the inlet passage is partially uncovered, the gas pressure forces become unbalanced. The pressure of the gas accelerates the piston head in its movement away from the outlet once the intersection of the internal cylinder and the inlet passage is partially uncovered.

In preferred embodiments of the present invention, the valve body includes an auxiliary passage which intersects the inlet passage at a position between the inlet and the internal cylinder. A fill fitting is attached to the valve body and connects with the auxiliary passage to permit pressurized gas to be supplied to the pressure vessel or removed from the pressure vessel through a flow path which includes the inlet, the inlet passage, the auxiliary passage and the fill fitting. Because all filling or removing of gas from the pressure vessel is provided without having to move the piston and does not use the outlet, the danger of contamination of the piston, the internal cylinder or the outlet during the filling process is avoided.

BRIEF DESCRIPTION OF THE DRAWINGS

FIG. 3 is a sectional view along section 3—3 of FIG. 2.

FIG. 4 is a sectional view along section 4—4 of FIG. 2.

FIG. 5 is a partial end view, partially in section, of the raft inflation valve of the present invention as actuation of the valve is beginning.

FIG. 6 is a sectional view along section 6—6 of FIG. 5.

DETAILED DESCRIPTION OF THE PREFERRED EMBODIMENTS

Figure 1:
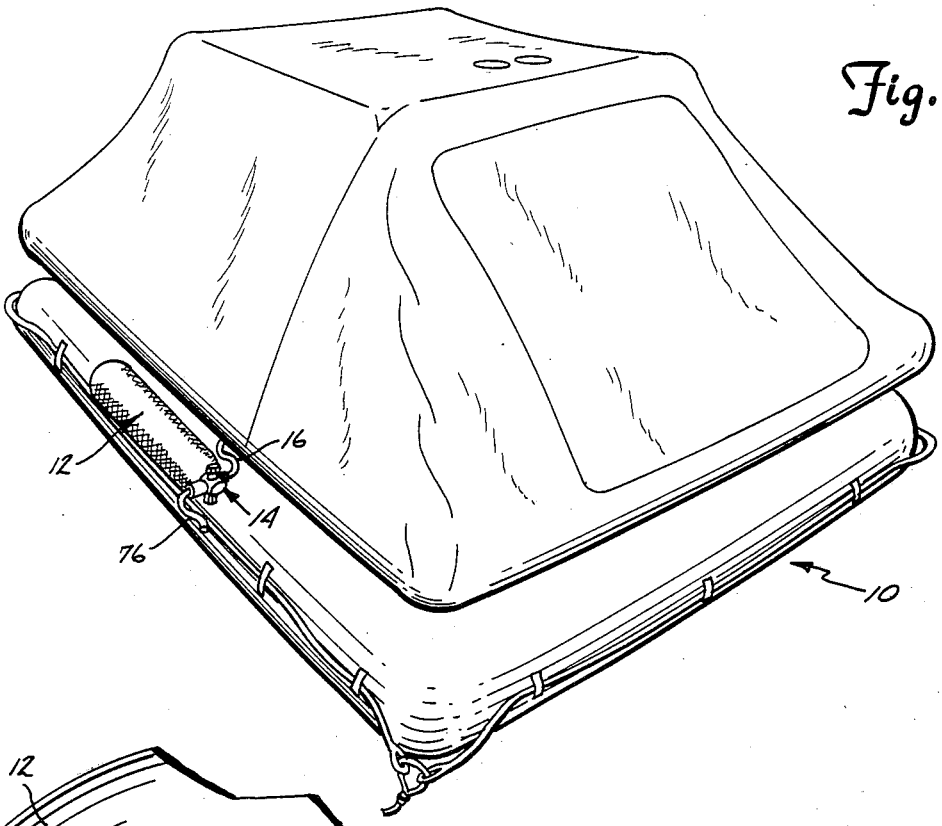
FIG. 1 is a perspective view of an inflatable life raft.

FIG. 1 shows inflatable life raft 10 in its fully inflated condition. The pressurized gas used to inflate life raft 10 has been supplied from one or more pressure vessels 12 which are attached to and carried by raft 10. Pressure vessel or tank 12 is typically a metal or metal-lined fiberglass tank which contains an inflation gas such as carbon dioxide, dry air, or nitrogen, stored under pressure. Each pressure tank 12 has a raft inflation valve 14 attached at one end. Under normal storage conditions, life raft 10 is deflated and stored in a compact package. A releasable pull cable (not shown in FIG. 1) is connected to valve 14 so that when the cable is pulled, valve 14 is actuated. This causes valve 14 to open, thus allowing the inflation gas from pressure tank 12 to pass through valve 14 and outlet hose 16 and into the interior of life raft 10.

Figure 2:
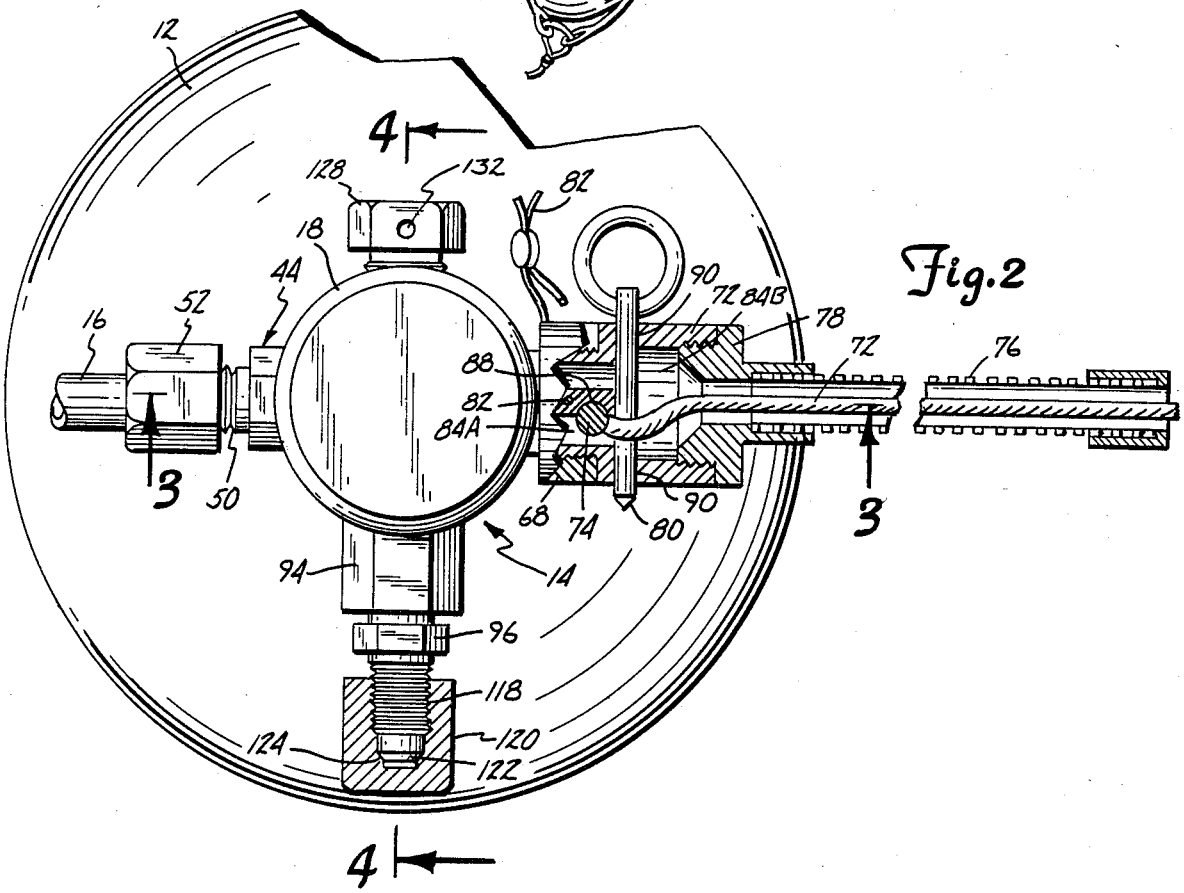
FIG. 2 is an end view, with portions shown in section, of the raft inflation valve of the present invention together with a pressure tank.

FIGS. 2–6 show raft inflation valve 14 of the present invention in further detail. FIG. 2 is an end view of tank 12 and valve 14 with portions shown in section. In FIG. 2, and in the sectional views shown in FIGS. 3 and 4, valve 14 is in its normal closed state prior to actuation. This is the state in which valve 14 is found when life raft 10 is deflated for storage.

Inflation valve 14 includes a stainless steel valve body 18 which has a threaded neck portion 20, inlet port 22, internal cylinder 24, outlet port 26, inlet passage 28, auxiliary passage 30, fill port 32, safety relief port 34, and retaining bore 36.

Threaded neck portion 20 of valve body 18 connects valve 14 to the end of tank 12. In the embodiment shown in FIG. 3 and 4, threaded neck portion 20 has a external (male) threads 38 which mate with internal (female) threads of the port (not shown) in the end of tank 12. O-ring tank seal 40 is positioned against shoulder 42 of valve body 18, and provides a seal between shoulder 42 and tank 12.

Inlet port 22 communicates with the interior of tank 12. Inlet passage 28 is connected at one end to inlet port 22, and at its other end it intersects internal cylinder 24. In the preferred embodiments of the present invention, the axis of inlet passage 28 intersects and is perpendicular to the axis of internal cylinder 24.

Outlet fitting 44 is threaded into outlet port 26, so that outlet passage 46 of outlet fitting 44 communicates with one end of internal cylinder 24. O-ring seal 48 provides a seal between outlet fitting 44 and valve body 18. In the embodiment shown in FIGS. 2 and 3, outlet fitting 44 has male threads 50 at its outer end which allow hose coupling 52 (which has cooperating female threads) to be connected to outlet fitting 44. Control of gas flow from inlet 22 through inlet passage 28 and internal cylinder 24 to outlet passage 46 and hose 16 is controlled by double-ended piston 54. As shown in FIG. 3, piston 54 includes piston head 56 and piston rod 58. Piston head 56 is a double-ended piston head having an O-ring seal 60 and backup ring 62 near its first end 56A, and O-ring seal 64 and backup ring 66 near its second end 56B. As shown in FIG. 3, valve 14 is closed, because piston 54 is positioned so that O-rings 60 and 64 are positioned on opposite sides of inlet passage 28 to prevent any leakage in either direction around piston head 54. Since there is no pressure difference between the opposite ends 56A and 56B of piston head 56 and no axial force is being applied to piston rod 58, piston 54 is in a stable, force balanced position within cylinder 24. Because of the balancing of gas pressure forces, piston 54 can be moved (for actuation) simply by overcoming the drag of O-rings 60 and 64 on the wall of internal cylinder 24. This results in a low actuation force that is only remotely related to the operating pressure of the inflation system.

Valve 14 is actuated to an open condition by pulling piston rod 58 in the axial direction so that piston head 56 moves away from outlet port 26 and toward retaining nut 68, which is threaded into passage 36. As soon as the end of piston head 56 clears a portion of the intersection of inlet passage 28 and internal cylinder 24, the pressurized gas begins to flow from tank 12 through inlet 22 and inlet passage 28 into internal cylinder 24. As O-ring 60 reaches inlet passage 28, the gas pressure force on piston 54 acting in the direction toward outlet port 26 drops, while the gas pressure force on piston 54 acting in the direction of retaining bore 36 is maintained, and thus the gas pressure forces on piston 54 become unbalanced. This gas pressure force differentual causes rapid acceleration of the movement of piston head 56 the remaining distance out of the way of inlet passage 28, which then allows the inflation gas to flow freely from inlet port 22 to outlet port 26. Retaining nut 68 limits the movement of piston head 56, so that the force of the pressurized gas does not blow piston 54 entirely out of internal cylinder 24.

Since the gas pressure forces acting on piston 54 are balanced by the double-ended configuration of piston 54 when the O-rings 60 and 64 are positioned on opposite sides of inlet passage 28 (valve closed), the pressure of the gas only affects actuation (pull) force by its effect on O-ring drag. Thus it can be seen that the actuating force required to move piston 54 is relatively low, and is in fact only the force required to overcome the drag at O-rings 60 and 64.

The actuating mechanism for valve 14 includes retaining nut 68, retaining guide 70, pull cable 72, ball 74, flexible conduit 76, conduit connector 78, safety pin 80 and safety wire 82.

Piston rod 58 extends out of the end of cylinder 24 through retaining nut 68 and into chamber 84 which is defined by retaining nut 68, retaining guide 70, and conduit connector 78. The outer end of piston rod 58 has a detent 86 which receives ball 74. Cable 72 is connected at one end to ball 74 and extends out of chamber 84 through flexible conduit 76. The outer end of pull cable 72 typically has a connecting device (not shown) which is attached to the ship.

Safety pin 80 shown in FIGS. 2 and 3 prevents accidental or unintended actuation of valve 14 by preventing axial movement of piston 54. Pin 80 is inserted through openings 90 in retaining guide 72, so that the shank of pin 80 butts the outer end of piston rod 58. As long as safety pin 80 is in place, piston 54 cannot be moved in the axial direction by pull cable 72.

When safety pin 80 is removed (as shown in FIG. 5), a pulling force on cable 72 causes ball 74 to move in the axial direction, thus pulling piston rod 58 outward in the axial direction. Chamber 84 has a portion 84A of smaller diameter which maintains ball 74 and detent 88 in a force transmitting relationship until piston rod 58 has been pulled far enough out that inlet passage 28 is partially uncovered by piston head 56. At that point, which is illustrated in FIGS. 5 and 6, ball 74 has reached second chamber portion 84B of a larger diameter. Ball 74 is then allowed to escape from detent 86, so that pull cable 72 can be pulled entirely out of chamber 84 and flexible conduit 76. Pull cable 72 must release valve 14 at the end of its stroke, because pull cable 72 is normally attached to its outer end to the ship, and valve 14 is actuated when life raft 10 is thrown overboard or when the ship sinks. In that type of application, cable 72 must disconnect entirely from valve 14 at the end of its stroke, so that life raft 10 is totally disconnected from the ship.

Portion 84A of chamber 84 has a diameter which is sufficiently small so that there is only one possible orientation of ball 74 and detent 86. Ball 74 cannot hang up or become lodged anywhere else in chamber 84 or in conduit 76.

Flexible conduit 76 provides a flexible guide for pull cable 72. The use of flexible conduit 76 allows cable 72 to apply an axial pulling force on piston rod 58 regardless of the direction of the pulling force on cable 72. In othe embodiments, flexible conduit 76 and conduit connector 78 are replaced by a round nose ferrule.

Safety wire 82 is threaded through safety wire passage 91, which extends through retaining nut 68 and piston rod 58. The outer ends of safety wire 82 are preferably twisted together, as shown in FIG. 2. Safety wire 82 provides a visual indication as to whether valve 14 has already been actuated. Safety wire 82 is broken when a pulling force is applied to piston rod 58 which results in actuation of valve 14.

An important advantage of valve 14 of the present invention is that it permits tank filling, tank bleed down, pressure measurement, and system (i.e. tank and valve) pressure proof testing without disturbance of piston 54 and without exposing internal cylinder 24, piston 54, and outlet fitting 44 to possible contamination that could subsequently result in inflation system failure. As best shown in FIG. 4, auxiliary passage 30 intersects inlet passage 28 between inlet port 22 and internal cylinder 24. Fill fitting assembly 92, which includes housing 94 and fill valve 96, is attached to valve body 18 at fill port 32. Housing 94 has threads 98 which are threaded into fill port 32. O-ring 100 provides a seal between valve body 18 and housing 94.

Fill valve 96 is threaded into housing 94, and has an inner end 102 which engages valve seat 104 of fill port 32. O-ring 110 and backup ring 112 provide a seal between fill valve 96 and housing 94. An internal passage 114 extends substantially the entire length of fill valve 96. Passage 114 ends at inner end 102 of fill valve 96, where it is intersected by passage 116.

At the outer end of fill valve 96 are male threads 118, which permit connection of other apparatus to fill fitting assembly 92 such as a source of gas (when tank 12 is to be filled), a pressure gauge (when the pressure in tank 12 is to be measured), or backup seal/threaded protector cap 120 as shown in FIG. 2 (under normal storage and use conditions).

When tank 12 is being filled or bled down or when pressure measurement or proof testing is being performed through fill fitting 92, fill valve 96 is backed out of housing 94 partially so that valve end 102 is no longer in engagement with valve seat 104. This permits gas flow between passage 114 of fill valve 96 and auxiliary passage 30 in valve body 18. Even when fill valve 96 is partially backed out, O-ring 110 maintains a seal between fill valve 96 and housing 94, so that the gas flow through fill fitting assembly 92 is controlled. To again bring valve end 102 into engagement with valve seat 104, fill valve 96 is rotated in an opposite direction. In any filling operation, the possibility of contamination being introduced exists. Fill assembly 92 minimizes the effects of contamination. First, if a soft contaminant is present at valve seat 104, the force applied as fill valve 96 is threaded inwardly into housing 94 tends to crush and displace the contamination. If a hard contaminant is present at valve seat 104, any leak at valve seat 104 is still minimized. In addition, by placing cap 120 on the outer end of valve 96, passage 114 is still sealed, because flare 122 at the outer end of valve 96 engages seat 124 of cap 120.

Valve 14 also includes a safety relief which prevents an explosion in the event that gas pressure within tank 12 reaches an unsafe level. The safety relief includes frangible disc 126 and disc retaining nut 128. Frangible disc 126 is located in safety port 34 at an opposite end of auxiliary passage 30 from fill fitting assembly 92. Retaining nut 128 is threaded into safety relief port 34, and holds frangible disc 126 in a position where it seals safety relief port 34. If the pressure within tank 12, and therefore within auxiliary passage 30, exceeds a predetermined level, frangible disc 126 ruptures. This permits inflation gas to flow out of tank 12, through inlet port 22, inlet passage 28 and auxiliary passage 30, through disc 126 into passage 130 of retaining nut 128, and out discharge vents 132.

As discussed previously, the valve 14 of the present invention permits proof testing of the inflation system (i.e. tank and valve together) through fill fitting assembly 92, without damage to valve 14. Because the proof testing involves pressures which are higher than the safety pressure, safety relief port 34 must be blocked so that frangible disc 126 is not ruptured during system proof testing.

The raft inflation valve 14 of the present invention provides a number of significant advantages. First, it provides ultra-high reliability because the portion of valve 14 which controls flow between inlet port 22 and outlet port 26 is not affected by contamination or environmental changes. Tank filling, tank bleed down, pressure measurement, and system proof testing can be performed independently through fill fitting 92.

Second, valve 14 is capable of operating over a wide pressure range, preferably up to and including 6,000 psi. This makes valve 14 usable with any of the commonly available inflation gases.

Third, the actuating of valve 14 involves only one moving part. This greatly enhances reliability and also makes valve 14 much easier to manufacture.

Fourth, valve 14 requires a very low actuating force (typically 10 to 20 pounds) even when the inflation gas is at a very high pressure.

Although the present invention has been described with reference to preferred embodiments, workers skilled in the art will recognize that changes may be made in form and detail without departing from the spirit and scope of the invention.

What is claimed is:

1. A normally closed valve which is actuated to permit flow of a pressurized inflation gas from a pressure vessel, the valve comprising:

a valve body having an inlet for connection to the pressure vessel, an outlet, an internal cylinder connected at a first end to the outlet, and an inlet passage which extends from the inlet and intersects the internal cylinder at a position intermediate the first end and a second end of the internal cylinder;

a double-ended piston positioned for axial movement in the internal cylinder, the piston having a piston head with first and second ends of equal diameter, a piston rod which is connected at a first end to the piston head and which has a second end extending out of the second end of the cylinder, and first and second spaced apart O-ring seals carried by the first and second ends of the piston head and positioned on opposite sides of the intersection of the internal cylinder and the inlet passage when the valve is in its normally closed condition; and valve actuating means for applying a pulling force directly to the second end of the piston rod in the axial direction away from the outlet to cause the piston head to move toward the second end of the internal cylinder to uncover the intersection of the internal cylinder and the inlet passage and permit gas flow from the inlet to the outlet; wherein the valve actuating means comprises a pull cable having a ball attached at one end for engaging a detent in the piston rod, so that pulling force on the cable is transmitted through the ball to the piston rod as a pulling force in the axial direction; and ball retaining guide means for maintaining the ball and the detent in force transmitting relationship as the ball pulls the piston rod until the intersection of the internal cylinder and the inlet passage is at least partially uncovered, and then permitting the ball to disengage the detent so that the pull cable is disconnected from the valve; and piston retaining means positioned at the second end of the internal cylinder for limiting axial movement of the piston head so that the piston head remains in the internal cylinder after actuation of the valve, the piston retaining means having an axial passage through which the piston rod extends.

2. The valve of claim 1 wherein the ball retaining guide means comprises a housing which surrounds the ball and the piston rod when the valve is in its normally closed position, the housing defining a first chamber in which the ball and the detent are maintained in force transmitting relationship and a second larger chamber which is further from the valve body in the axial direction and in which the ball is permitted to disengage the detent.

3. The valve of claim 1 wherein the piston retaining means is connected to the valve body and the ball retaining guide means is connected to the piston retaining means.

4. The valve of claim 3 and further comprising flexible conduit means connected at one end to the ball retaining guide means for guiding the pull cable.

5. The valve of claim 3 wherein the valve body includes a female threaded bore located at the second end of the internal cylinder, wherein the retaining means comprises a retaining nut having a male threaded portion which engages the female threaded bore.

6. The valve of claim 1 and further comprising safety pin means for engaging an outer end of the piston rod to prevent axial movement of the piston from the normally closed position as long as the safety pin means is in place.

7. The valve of claim 1 wherein the valve body further includes an auxiliary passage which intersects the inlet passage between the inlet and the internal cylinder, and an auxiliary port connected to the auxiliary passage, and wherein the valve further includes means for controlling gas flow between the auxiliary port and the inlet.

8. The valve of claim 7 wherein the auxiliary port includes a valve seat at an end of the auxiliary passage which is connected to the auxiliary port, and wherein the means for controlling gas flow between the auxiliary port and the inlet comprises:

a housing connected to the auxiliary port and defining a chamber; and an auxiliary valve movable along an axis in the chamber, the auxiliary valve having an inner end and outer end, a valve passage which extends from a first opening near the outer end to a second opening near the inner end, and an O-ring seal located between the first and second openings to provide a seal between the auxiliary valve and the housing, wherein the auxiliary valve is movable to a closed position in which the inner end of the auxiliary valve engages the valve seat to block gas flow between the auxiliary passage and the valve passage, and wherein the auxiliary valve is movable to an open position in which the inner end of the auxiliary valve is spaced from the valve seat to permit gas flow between the auxiliary passage and the valve passage.

9. The valve of claim 8 wherein the chamber has a female threaded portion and the auxiliary valve has a mating male threaded portion, and wherein movement of the auxiliary valve along the axis is caused by rotation of the auxiliary valve with respect to the housing.

10. The valve of claim 7 wherein the valve body further includes a safety passage which is connected to the inlet passage, and a safety relief port connected to the safety passage, and wherein the valve further includes a frangible disc positioned in the safety relief port to block normally the safety passage and for rupturing when pressure in the safety passage exceeds a predetermined level, and disc retaining means for retaining the disc in the safety relief port, the disc retaining means having a relief passage which is connected to the safety passage when the disc ruptures.

11. A normally closed valve which is actuated to permit flow of a pressurized inflation gas from a pressure vessel, the valve comprising:

a valve body having an inlet for connection to the pressure vessel, an outlet, an internal cylinder connected at a first end to the outlet, and an inlet passage which extends from the inlet and intersects the internal cylinder at a position intermediate the first end and a second end of the internal cylinder;

a double-ended piston positioned for axial movement in the internal cylinder, the piston having first and second piston heads with ends of equal diameter, a piston rod which is connected at a first end to the second piston head and which has a second end extending out of the second end of the cylinder, and first and second spaced apart O-ring seals carried by the first and second piston heads, respectively, and positioned on opposite sides of the intersection of the internal cylinder and the inlet passage when the valve is in its normally closed condition so that due to the equal diameters of the ends of the first and second piston heads gas pressure forces of the inflation gas applied to the piston toward the first end and the second end are balanced and thus cancelled and the piston remains in a stationary, force-balanced state without application of any bias force when the valve is in its normally closed position; and firing means for actuating the valve when pulled by applying a pulling force directly to the second end of the piston rod in the axial direction away from the outlet to cause the piston heads to move toward the second end of the internal cylinder to uncover partially the intersection of the internal cylinder and the inlet passage which unbalances the gas pressure forces on the ends of the first and second piston heads and causes the unbalance in gas pressure forces to drive the piston a remaining distance toward the second end and permits unrestricted gas flow from the inlet to the outlet, the firing means including means for engaging the second end of the piston rod to apply the pulling force and then disengaging the second end when the gas pressure forces are unbalanced to detach the firing means from the valve.

12. The valve of claim 11 and further comprising:

piston retaining means positioned at the second second end of the internal cylinder for limiting axial movement of the piston head so that the piston head remains in the internal cylinder after actuation of the valve, and wherein the piston retaining means has an axial passage through which the piston rod extends.

13. The valve of claim 12 wherein the firing means comprises a pull cable having a ball attached at one end, and wherein the piston rod has a detent for receiving the ball, so that pulling force on the cable is transmitted through the ball to the piston rod.

14. The valve of claim 13 and further comprising ball retaining guide means for maintaining the ball and the detent in force transmitting relationship until the intersection of the internal cylinder and the inlet passage is at least partially uncovered, and then permitting the ball to disengage the detent so that the pull cable is disconnected from the raft inflation valve.

15. The valve of claim 14 wherein the ball retaining guide means comprises a housing which surrounds the ball and the piston rod when the raft inflation valve is in its normally closed position, the housing defining a first chamber in which the ball and the detent are maintained in force transmitting relationship and a second larger chamber which is further from the valve body in the axial direction and in which the ball is permitted to disengage the detent.

16. The valve of claim 14 wherein the piston retaining means is connected to the valve body and the ball retaining guide means is connected to the piston retaining means.

17. The valve of claim 16 and further comprising flexible conduit means connected at one end to the ball retaining guide means for guiding the pull cable.

18. The valve of claim 16 wherein the valve body includes a female threaded bore located at the second end of the internal cylinder, wherein the retaining means comprises a retaining nut having a male threaded portion which engages the female threaded bore.

19. The valve of claim 11 and further comprising safety pin means for engaging an outer end of the piston rod to prevent axial movement of the piston from the normally closed position as long as the safety pin means is in place.

20. The valve of claim 11 wherein the valve body further includes an auxiliary passage which intersects the inlet passage between the inlet and the internal cylinder, and an auxiliary port connected to the auxiliary passage, and wherein the raft inflation valve further includes means for controlling gas flow between the auxiliary port and the inlet.

21. The valve of claim 20 wherein the auxiliary port includes a valve seat at an end of the auxiliary passage which is connected to the auxiliary port, and wherein the means for controlling gas flow between the auxiliary port and the inlet comprises:

a housing connected to the auxiliary port and defining a chamber; and an auxiliary valve movable along an axis in the chamber, the auxiliary valve having an inner end and outer end, a valve passage which extends from a first opening near the outer end to a second opening near the inner end, and an O-ring seal located between the first and second openings to provide a seal between the auxiliary valve and the housing, wherein the auxiliary valve is movable to a closed position in which the inner end of the auxiliary valve engages the valve seat to block gas flow between the auxiliary passage and the valve passage, and wherein the auxiliary valve is movable to an open position in which the inner end of the auxiliary valve is spaced from the valve seat to permit gas flow between the auxiliary passage and the valve passage.

22. The valve of claim 21 wherein the chamber has a female threaded portion and the auxiliary valve has a mating male threaded portion, and wherein movement of the auxiliary valve along the axis is caused by rotation of the auxiliary valve with respect to the housing.

23. The valve of claim 20 wherein the valve body further includes a safety passage which is connected to the inlet passage, and a safety relief port connected to the safety passage, and wherein the raft valve further includes a frangible disc positioned in the safety relief port to block normally the safety passage and for rupturing when pressure in the safety passage exceeds a predetermined level, and disc retaining means for retaining the disc in the safety relief port, the disc retaining means having a relief passage which is connected to the safety passage when the disc ruptures.

* * * * *